United States Patent [19]

Loisel et al.

[11] Patent Number: 4,733,701

[45] Date of Patent: Mar. 29, 1988

[54] TOOL FOR TIGHTENING AND CUTTING CLAMPS

[75] Inventors: Francois Loisel, Maromme; Marc Gosse, Cleres; Patrick Hauchard, Deville Les Rouen; Jean C. Auger, Le Trait, all of France

[73] Assignee: Legrand, Limoges, France

[21] Appl. No.: 894,657

[22] Filed: Jul. 30, 1986

[30] Foreign Application Priority Data

Jul. 30, 1985 [FR] France ..... 85 11595

[51] Int. Cl.[4] ..... B21F 9/02

[52] U.S. Cl. ..... 140/93.2; 140/123.6

[58] Field of Search ..... 140/93.2, 123, 123.6, 140/123.5

[56] References Cited

U.S. PATENT DOCUMENTS

| | | | |
|---|---|---|---|
| 3,344,815 | 10/1967 | Lawson et al. | 140/123.6 |
| 3,645,302 | 2/1972 | Caveney et al. | 140/93.2 |
| 3,782,426 | 1/1974 | Morgan et al. | 140/93.2 |
| 3,830,263 | 8/1974 | Benfer | 140/123.6 |
| 4,047,545 | 9/1977 | Paradis | 140/93.2 |
| 4,081,002 | 3/1978 | Violi | 140/123.6 |

FOREIGN PATENT DOCUMENTS

| | | |
|---|---|---|
| 2405789 | 3/1980 | France . |
| 2400995 | 5/1980 | France . |
| 1031684 | 6/1966 | United Kingdom . |
| 1587370 | 4/1981 | United Kingdom . |

*Primary Examiner*—Lowell A. Larson

*Attorney, Agent, or Firm*—Charles E. Brown; Charles A. Brown

[57] ABSTRACT

A tool for tightening and cutting clamps comprises two handles pivoted to each other of which one is a tightening handle and has at its end a grasping member adapted to grasp the clamp to be cut. The other handle is a cutting handle and has at its end a movable cutter. Elastic element oppose movement of the grasping and cutting handles towards each other. An actuator to apply thrust to the cutter and elastic return element opposes movement of the cutter. The actuator comprises the pivot by which the handles are pivoted to each other and a curved slot in the cutting handle by which the cutting handle is fastened to the pivot and in which the pivot is movable parallel to itself, transversely to the pivot axis.

17 Claims, 19 Drawing Figures

FIG. 11
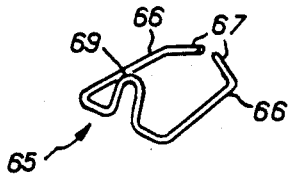
FIG. 12
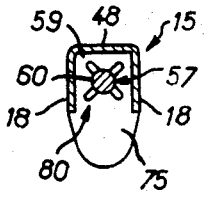
FIG. 13
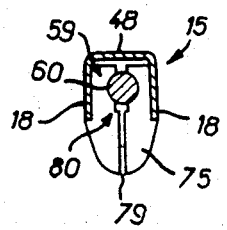
FIG. 14
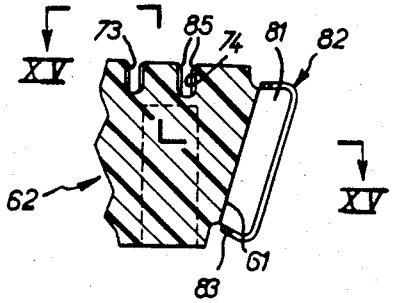
FIG. 16
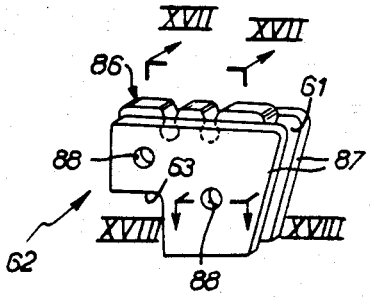
FIG. 17
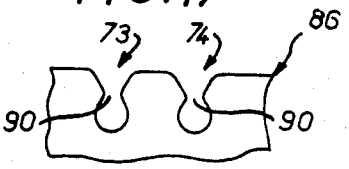
FIG. 15
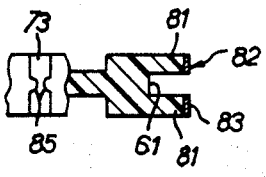
FIG. 18
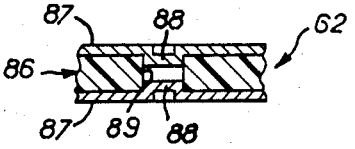
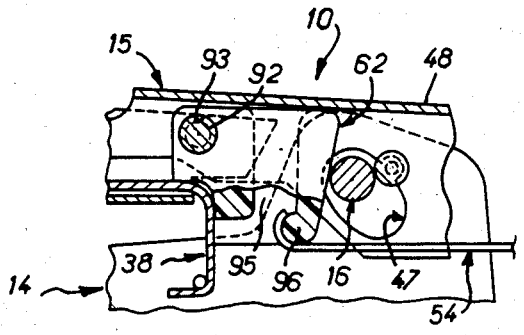
FIG. 19

TOOL FOR TIGHTENING AND CUTTING CLAMPS

BACKGROUND OF THE INVENTION

1. Field of the Invention

The present invention is generally concerned with tools for tightening and then cutting clamps, for example the flexible strip of a tie clamp looped around one or more objects.

Two types of tool are currently available for this purpose.

The first type covers tools comprising two handles pivoted to each other and operating against elastic return means, comprising a first handle hereinafter referred to for convenience only as the tightening handle which has at its end grasping means adapted to grasp the clamp to be cut and a second handle hereinafter referred to for convenience only as the cutting handle which has at its end a cutter movable against elastic return means, with actuator means adapted to exert thrust on said cutter.

A tightening and cutting tool of this kind is described for example in French Pat. No. 2 400 995 filed June 2, 1977 under application No. 77 16827.

In this patent the actuator means adapted to exert thrust on the cutter are controled by a specific lever pivoted to the cutting handle for operation by the user.

This arrangement is satisfactory and advantageously results in relatively simple and economical forms of construction.

It does leave the choice of the moment to make the cut up to the user, however.

Thus cutting is done independently of the tensioning of the clamp to be cut.

If this tension, on which ultimately depends the clamping action of the clamp on the object or objects that it surrounds, is insufficient, then the clamping may be inadequate.

The second type of tightening and cutting tool for clamps currently available covers tools comprising a plate with one end which forms a fixed handle used to manipulate the assembly and, facing this fixed handle, a movable handle which is pivoted to the plate and which controls a tightening and cutting mechanism supported by the plate.

A tool of this kind is described for example in U.S. Pat. No. 4,081,002 granted Mar. 28, 1978.

It has the advantage of utilising a detent mechanism, that is to say a sudden release mechanism, systematically making the cut immediately when the tension on the clamp to be cut reaches a predetermined value.

The corresponding forms of construction are relatively complex, however, and therefore costly.

A general object of the present invention is a tool for tightening and cutting clamps that is free of these disadvantages and offers other advantages.

SUMMARY OF THE INVENTION

The present invention consists in a tool for tightening and cutting clamps comprising two handles pivoted to each other of which one is a tightening handle and has its end grasping means adapted to grasp the clamp to be cut and the other of which is a cutting handle and has at its end a movable cutter, elastic means adapted to oppose movement of said grasping and cutting handles towards each other by pivoting, actuator means adapted to apply thrust to said cutter and elastic return means adapted to oppose movement of said cutter, wherein said actuator means comprise the pivot by which said handles are pivoted to each other and a curved slot in said cutting handle by which said cutting handle is fastened to said pivot and in which said pivot is moveable parallel to itself, transversely to the pivot axis.

By virtue of an arrangement such as this, and even though the tool is in practise one of the first type, there is developed a detent type operation, that is to say a sudden release operation, of the cutter so that, as in a tool of the second type, cutting is executed systematically as soon as the tension applied to the clamp to be cut reached a predetermined value.

In essence, the tightening and cutting tool in accordance with the invention combines in a particularly simple and economical manner the advantages of the two prior art types of tightening and cutting tool.

The characteristics and advantages of the invention will emerge from the following description given by way of example only and with reference to the accompanying diagrammatic drawings.

BRIEF DESCRIPTION OF THE DRAWINGS

FIG. 11 is a perspective view analogous to that of FIG. 6 for an alternative embodiment of the latch.

FIG. 12 is a partial view in transverse cross-section of another embodiment of the tightening and cutting tool in accordance with the invention on the line XII—XII in FIG. 1.

FIG. 13 is a partial view of a further embodiment in transverse cross-section, analogous to that of FIG. 12.

FIG. 14 is a view in cross-section repeating part of the elevation view in cross-seection of FIG. 1 for an alternative embodiment of the plunger of the tightening and cutting tool in accordance with the invention.

FIG. 15 is a partial view of the plunger in cross-section on the broken line XV—XV in FIG. 14.

FIG. 16 is a perspective view of another embodiment of the plunger.

FIG. 17 is a partial view in elevation of one of the component parts of the plunger, on the line XVII—XVII in FIG. 16.

FIG. 18 is a partial view of it in cross-section on the line XVIII—XVIII in FIG. 16.

FIG. 19 is a view analogous to that FIG. 10, which it repeats in part, relating to a further embodiment.

DESCRIPTION OF THE PREFERRED EMBODIMENTS

Figure 7:
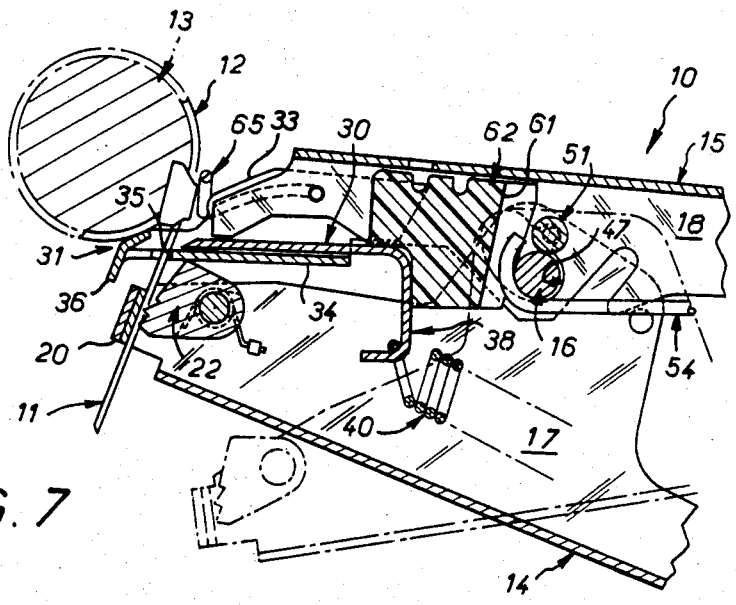
FIGS. 7 and 8 are views which each repeat to a larger scale part of FIG. 1, showing two phases of functioning of the tightening and cutting tool in accordance with the invention.
Figure 8:
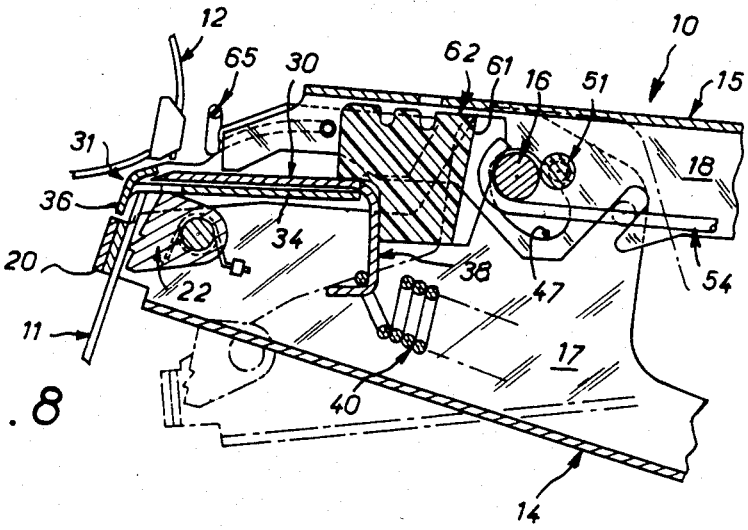

As shown in the figures, and more specifically in FIGS. 7 and 8, the tightening and cutting tool 10 in accordance with the invention is designed to enable a user to tension any form of clamp, for example the flexible strip 11 of a tie clamp 12 looped around one or more objects 13, and then to cut it.

Generally speaking, as shown here the tightening and cutting tool 10 in accordance with the invention comprises two handles 14, 15 pivoted to each other about the axis of a common pivot 16 and operating against elastic return means to be described in detail later.

In the embodiments shown both the handles 14, 15 have a U-shaped transverse cross-section, both being made from appropriately cut out and folded sheet metal, for example.

Their concave sides face towards each other and their branches nest one within the other about their common pivot 16.

In the embodiments shown the branches 17 of the handle 14, referred to hereinafter for conveninece only as the tightening handle, are on the outside of the branches 18 of the handle 15, referred to hereinafter for convenience only as the cutting handle.

The end of the tightening handle 14 is fitted with grasping means adapted to grasp the clamp 11 to be cut.

In the embodiments shown these grasping means comprise a transverse wall 20 which extends from one of the branches 17 of the tightening handle 14 to the other and is in practise formed by right-angle upstands integral with a respective one of said branches 17, appropriately superposed one on the other, so as to expose an opening 21 adapted to have the clamp 11 to be cut inserted into it; the grasping means further comprise a ratchet 22 rotatably mounted on a pivot 23 disposed transversely between the branches 17 of the tightening handle 14 for this purpose and acted on by a torsion spring 24 that continuously urges its notched head 25 towards the transverse wall 20, interfering within this range with the opening 21.

In practise the torsion spring 24 has its central torsion part fitted over the pivot 23, one end bearing against the ratchet 22 and the other end bearing on a tab 26 stamped into one of the branches 17 of the tightening handle 14 for this purpose.

So as to limit the idle travel with the tool closed (FIG. 1) and thus to leave at least partially exposed the passage 21 for the clamp 11 to be cut to be inserted into, the ratchet 22 has a bearing tab 28.

At the corresponding end of the coupling handle 15 there is a cutter 30 that can slide against the action of elastic return means to be described in detail later.

In practise, in the embodiments shown said end of the cutting handle 15 is formed by a nose 31 which consists of a part separate to the main part 32 thereof and is appropriately fastened to it, as by welding, for example.

Like the main part 32 the nose 31 has a U-shaped transverse cross-section and like the tightening handle 14 its concave side faces towards that of the main part 32 and its branches 33 lie outside the branches 18 thereof.

The median part 34 of the nose 31 forms a guiding plate for the sliding cutter 30.

In line with the opening 21 in the tightening handle 14 it has an opening 35 for the clamp 11 to be cut to pass through.

In the embodiments shown there is provided at the end of the median part 34 of the nose 31 of the cutting handle 15 a tang projection from the median part 34 to form with the latter an acute dihedron between the corresponding branches 33.

In practise, in these embodiments, the tang 37 is obtained by stamping the median part 34 and, in order to produce the tang 37, the median part 34 is extended by a beak 36 which projects from the side opposite the branches 33 to form an obtuse dihedron with the tank 37.

In the embodiments shown the sliding cutter 30 is part of an elbow-shaped member 38, to be more precise a U-shaped member of which it forms one branch, this branch being significantly longer than the other.

In practise the elastic return means associated with the two handles 14, 15 on the one hand and those associated with the sliding cutter 30 on the other hand are formed by one and the same spring 40.

In this instance this is a tension spring which has one end coupled to the U-shaped member 38 of which the sliding cutter 30 forms part, by means of the bent part of this member opposite to the part forming the sliding cutter 30, and which has its other end coupled to a tang 41 formed by stamping the median part of the tightening handle 14, between the branches 17 thereof.

In order to exert thrust on the sliding cutter 30, to be more precise on the U-shaped member of which it forms part, there are provided in the tightening and cutting tool 10 in accordance with the invention actuator means.

In accordance with the invention these actuator means comprise the pivot 16 itself about the axis of which the two handles 14, 15 pivot.

In practise the pivot 16, which essentially consists of a cylindrical barrel 42 of circular cross-section, passes through the handles 14, 15 generally perpendicular to the branches 17, 18 thereof.

Figure 2:
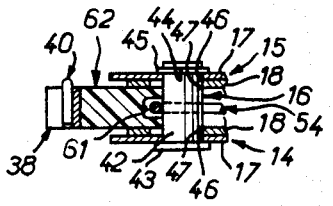
FIGS. 2 and 3 are parital view in transverse cross-section on the respective lines II—II and III—III in FIG. 1.
Figure 3:
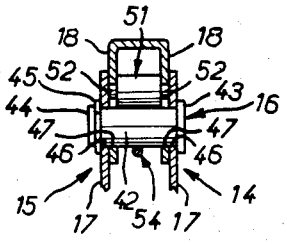

At one end it has an external head 43 through which it bears on the corresponding branch 17 of the tightening handle 14 (FIGS. 2 and 3).

To retain it axially it features at its other end a groove 44 adapted to receive, for example, a split spring washer 45 in turn adapted to bear on the outside of the other branch 17 of the tightening handle 14.

Figure 4:
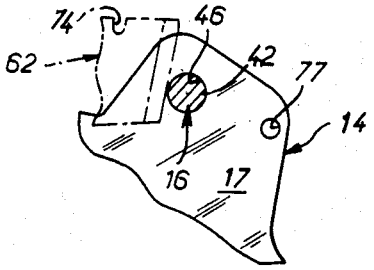
FIG. 4 is a view partly reproducing that of FIG. 1, showing one of the handles of the tightening and cutting tool in accordance with the invention.

The thus constituted pivot 16 is engaged with the tightening handle 14 by a circular hole 46 in the tightening handle 14, to be more precise in each of the branches 17 thereof (FIGS. 2, 3 and 4), sized to complement its barrel 42.

On the other hand, it is engaged with the cutting handle 16 through a curved slot 47 provided for this purpose in the cutting handle 16, to be more precise in each of the branches 18 thereof, and in which it is able to move parallel to itself, that is to say transversely relative to its axis.

The curved slot 47 that the cutting handle 15 thus features, which is a slot of the kind usually referred to as "kidney-shaped", extends generally obliquely relative to the central part 48 of the cutting handle 15, with its concave side facing away from the nose 31 thereof.

Each of its end lobes 49 has a partly circular contour complementing that of the barrel 42 of the pivot 16.

In the embodiments shown the re-entrant part 50 of its contour, between its end lobes 49, is defined by a roller 51 rotatably mounted on the cutting handle 15 between the branches 18 thereof.

To this end the roller 51 has at its ends journals 52 through which it is engaged in circular contour recesses formed in the branches 18 of the cutting handle 15 and opening freely into the slot 47.

In the embodiments shown the journals 52 are in one piece with the main part of the roller 51.

As an alternative to this, however, in order to minimize friction and thus improve the conditions under which the pivot 16 rolls, they may be formd by the ends of a spindle on which is rotatably mounted the main part of the roller 51, forming a rim.

The pivot 16 is acted on by elastic return means which urge it continuously towards one of the end lobes 49 of the slot 47 in the cutting handle 15.

In practise, in the embodiments shown, the elastic return means associated with the pivot 16 consist of a specific spring 54.

In this instance it is a tension spring coupled at one end to a strap 55 for adjusting the tension in it.

In the embodiments shown this strap 55 comprises a part 56 forming a nut to which the spring 54 is coupled and which is disposed movably in the cutting handle 15, between the branches 18 thereof, and an adjuster screw 57 the head 58 of which is external to said cutting handle 15 and bears on the coresponding transverse end wall 59 thereof; inside said cutting handle 15 its shank 60 is screwed into the aforementioned part 56 forming a nut.

In the embodiments specifically shown in FIGS. 1 through 18 the other end of the spring 54 is coupled to the pivot 16.

Be this as it may, the elastic return means constituted by this spring 54 continuously urge the pivot 16 towards the end lobe 49 of the slot 47 in the cutting handle 50 which is farthest away from the median part 48 thereof.

Between the pivot 16 and the sliding cutter 30 there is disposed, in the embodiments shown, a plunger 62.

In the embodiment specifically shown in FIGS. 1 through 10, this is in practise of unitary construction, consisting for example of a block of synthetic material.

Be this as it may, the plunger 62 is disposed movably in the cutting handle 15, between the branches 18 thereof.

Through one of its transverse surfaces it bears on the U-shaped member 38 of which the sliding cutter 30 forms part. The pivot 60 bears on its opposite transverse surface.

In practise that of its transverse surfaces through which it bears on the U-shaped member 38 features to this end a right-angle step 53 through which it is engaged with the bent part of the U-shaped member 38 which is formed by the median part thereof and the sliding cutter 30.

As shown here, the transverse surface 64 of the plunger 62 on which the pivot 60 bears is preferably oblique relative to the sliding cutter 30, which advantageously permits demultiplication of the force applied to it.

In practise, in the embodiments shown in FIGS. 1 through 18, this transverse surface 64 of the plunger 62 has in its median part a longitudinal groove 61 adapted to accommodate the end of the return spring 54 of the pivot 16 by which the return spring 54 is hooked onto the pivot 16, to enable unimpeded contact of the latter with this transverse surface 64.

As an alternative to this, a groove may be provided on the pivot 16 for hooking on the return spring 64.

In the embodiments shown in FIGS. 1 through 18 there is a latch 65 associated with the plunger 62 for locking it in position.

As shown here, for example, the latch 65 is pivoted to the cutting handle 15.

In this instance it is a generally U-shaped pin of round cross-section wire.

The branches 66 of this pin lie one on each side of the cutting handle 15, being pivoted to it by the inwardly bent ends 57 of the branches 66 which cooperate with holes 68 in the branches 18 of said cutting handle 15.

In the embodiments specifically shown in FIGS. 1 through 10, the bent ends 57 are substantially at right angles.

Through its median part, appropriately shaped for this purpose, the pin constituting the latch 55 forms a transverse abutment 69 through which it is adapted to cooperate with the plunger 62 in order to retain it, as will be described in more detail later, after passing through a passage 70 provided for this purpose in the median part 42 of the cutting handle 15.

In the embodiment specifically shown in FIGS. 1 through 10, the median part of this pin features kinks 71 at the base of the abutment 69, which is generally U-shaped.

Figure 1:
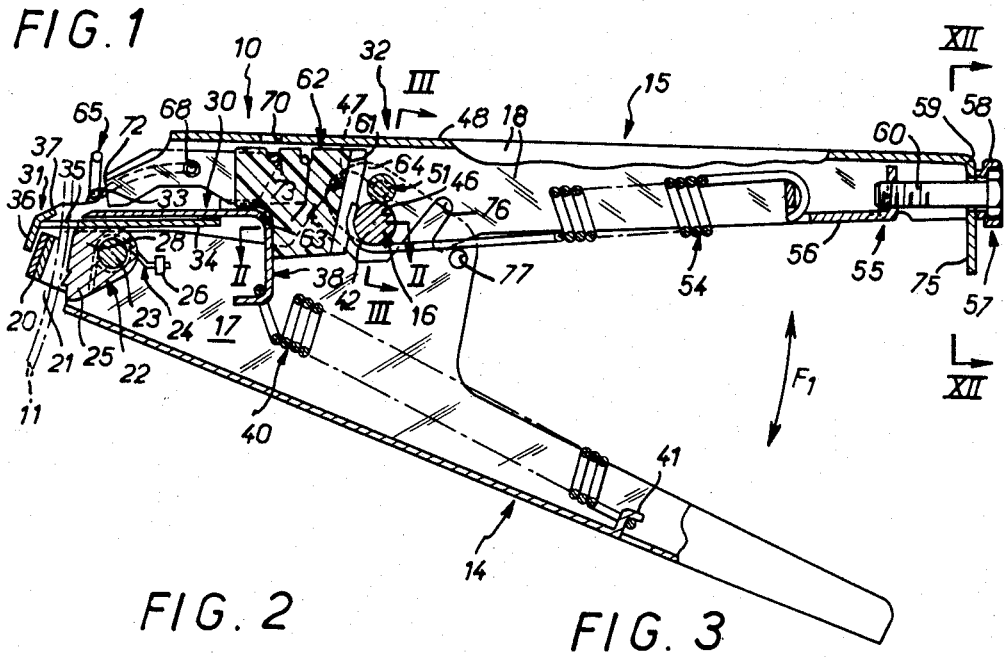
FIG. 1 is a view in elevation and cross-section of a tightening and cutting tool in accordance with the invention.
Figure 9:
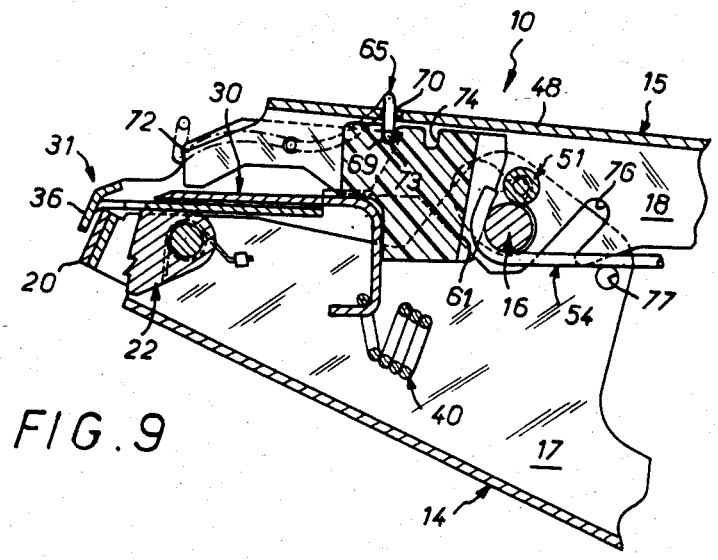
FIGS. 9 and 10 are views which also repeat to a larger scale part of FIG. 1, showing two embodiments of the latch.
Figure 10:
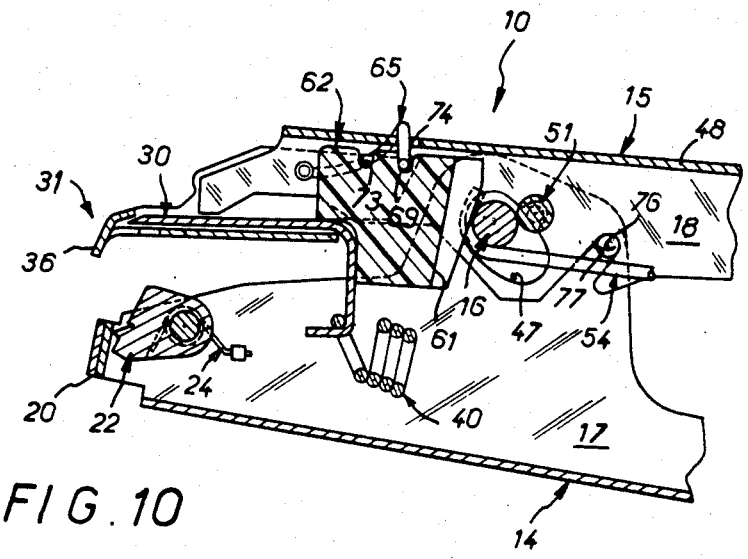

In practise the latch 65 so constituted is mounted to swing between two positions, a standby position in which, as shown in full line in FIG. 1 and in dashed line in FIG. 9, it is inoperative relative to the plunger 62 and a working position in which, as shown in full line in FIGS. 9 and 10, it is adapted to operate on it.

For holding the latch 65 in the standby position the branches 33 of the nose 31 on the cutting handle 15 preferably form, by means of appropriate cut-out parts, pegs 72 onto which the latch 65 may be clipped in the standby position by the bends which its branches 66 form with its median part.

For the purpose of cooperation with the latch 65 the plunger 62 comprises, in the embodiment shown, two transverse grooves 73, 74 spaced from each other on the transverse surface which is substantially parallel to the median part 48 of the cutting handle 15.

In the embodiment specifically shown in FIGS. 1 through 10, these grooves 73, 74 are simply U-shaped.

Either of the handles 14, 15 preferably has at the end opposite the grasping means consisting of the transverse end wall 20 of the tightening handle 14 and th ratchet 22 a tab 75 adapted to limit its movement relative to the other, by butting up against it.

In the embodiments shown this tab 75 is on the cutting handle 15, being formed by an extension of the transverse end wall 59 thereof (FIG. 1).

Finally, in the embodiment specifically shown in full line in FIGS. 1 through 10, and for reasons which will emerge hereinafter, the branches 18 of the cutting handle 15 feature, in the vicinity of the slot 47, a recess 76 extending obliquely in the opposite direction to that in which the slot 47 extends obliquely, the branches 17 of the tightening handle 14 featuring a hole 77 in substantially corresponding relationship thereto.

In the unoperated state (FIG. 1) the handles 14, 5 are in a closed position: acted on by the return spring 54, the pivot 16 is in the end lobe 49 of the slot 47 in the cutting handle 15 which is farthest away from the median part 48 thereof, the U-shaped member 38 of which the sliding cutter 30 forms part, itself acted on by the spring 40, bearing against the pivot 16, through the intermediary of the plunger 62, said sliding cutter 30 then exposing the opening 35 in the median part 34 of the nose 31 on the cutting handle 15; through its bearing tab 28 the ratchet 22 bears against said median part 34, on the side thereof opposite the sliding cutter 30, exposing the opening 31 in the tightening handle 14.

To use it the tightening and cutting tool 10 in accordance with the invention is fitted over the clamp 11 to be cut by means of the openings 21, 28 which are thus exposed, as schematically shown in dashed line in FIG. 1, and the ends of the handles 14, 15 furthest removed from the clamp 11 are moved towards each other as shown by the double-headed arrow F1 in FIG. 1 so as to open the tool.

During this movement, because the median part 34 of the nose 31 of the cutting handle 15 moves away from the ratchet 22 on the tightening handle 14, the ratchet 22, being acted on by its spring 24, grips the clamp 11 to be cut by holding it against the transverse end wall 20 with which it is associated.

The clamp 11 to be cut being thus gripped by the tightening handle 14, it is then progressively tightened as the aforementioned opening movement continues (figure 7).

During this opening movement there occurs simple relative pivoting of the handles 14, 15 about the axis of their common pivot 16, which is held by its spring 54 in the end lobe 49 of the slot 47 in the cutting handle 15 that is farthest away from the median part 48 thereof.

As the tension on the clamp 11 to be cut increases, the tension to which the spring 54 is subjected also increases to the point where, the spring 54 suddenly yielding, the pivot 16, as a result of the action on it of the tightening handle 14, moves parallel to itself, in other words transversely to its axis, from one of the end lobes 49 of the slot 47 in the cutting handle 15 to the other, passing through the point of maximum resistance associated with the roller 51 forming the re-entrant part of the contour of the slot 47 (FIG. 8).

As it moves the pivot 16 pushes back the plunger 62 and itself propels the U-shaped member 38 of which the sliding cutter 30 forms part so that, as a result of the thrust which is thus exerted on it, the cutter is driven hard against the clamp 11 to be cut and so cuts through it.

As will be readily understood, when the clamp 11 has been cut in this way the sliding cutter 30 becomes engaged on the tang 37 at the end of the nose 31 on the cutting handle 15, which prevents it being dragged down by the clamp 11.

FIGS. 7 and 8 show in full line the position of the tightening handle 14 corresponding to the minimal open configuration of the device before such cutting is initiated and in dashed line the position corresponding to the maximal open configuration.

As will be noted, the movement of the pivot 16 in its slot 47 in the cutting handle 15 is obviously accompanied by movement of the tightening handle 14 as a whole relative to the cutting handle 15, which results in the transverse end wall 20 of the tightening handle 14 coming into line with the edge of the beak 36 on the cutting handle 15 (FIG. 8).

The opening action previously exerted on the tightening and cutting tool 10 in accordance with the invention being released, the spring 54 associated with the pivot 16 returns the pivot 16 to its initial position, in that of the end lobes 49 of the slot 47 in the cutting handle 15 farthest away from the median part 48 thereof, and at the same time the spring 40 returns the handles 14, 15 to their initial (tool closed) position and the U-shaped member 38 of which the sliding cutter 30 forms part to its initial unoperated position in which the sliding cutter 30 exposes the opening 28 in the median part 34 of the nose 31 on the cutting handle 15.

The tightening and cutting tool 10 in accordance with the invention thus returns of its own accord to the closed configuration.

When it is in this closed configuration (FIGS. 1 and 9), it is possible by pivoting it about the bent in ends 67 of its branches 56 to engage the latch 65 with the groove 73 in the plunger 62 through the abutment 69 which its median part forms.

Being then locked in position, the plunger 62 opposes any movement of the pivot 16 in the slots 47 in the cutting handle 15 so that if an opening action is applied to the tool the clamp gripped by the ratchet 22 is merely tensioned without being cut.

Likewise, after demounting the spring 54 by acting on the adjuster screw 57, it is possible with the tool in a sufficiently open configuration for the pivot 16 to be moved towards the opposite end lobe 49 of the slot 47 in the cutting handle 15, to engage the latch 65 with the second groove, that is the groove 74, in the plunger 62, as shown in FIG. 10.

In the corresponding configuration of the tightening and cutting tool 10 in accordance with the invention, the hole 77 in the tightening handle 14 is substantially aligned with the bottom of the recess 76 in the cutting handle 15 so that, by inserting any form of rod or pin into this passage 77, it is possible to lock the handles 14, 15 in their corresponding positions.

It is then a very simple matter to remove the pivot 16, in order to dismantle the assembly, if required.

In the embodiment shown in FIG. 11, the bent ends 67 of the branches 66 of the pin constituting the latch 65 are not at right-angles to the branches 66, instead extending obliquely relative to them, forming with them an obtuse dihedron.

This results in improved retention of the latch 65 when it is in the operative position, interlocked with the plunger 62, and also in improved elasticity with regard to its clipping onto the cutting handle 15 when it is in the standby position.

Also, in this embodiment the branches 66 of the latch 65 are themselves slightly oblique to each other and no kinks are provided at the base of the abutment 69 that its median part forms.

In the embodiment shown in FIG. 12 there is provided on the transverse end wall 59 of the cutting handle 15, for the purpose of braking the adjuster screw 57, a star-shaped cut-out 80 with four branches, for example and as shown here, and on its corresponding transverse surface said adjuster screw 57 has a radial or even diametral projecting rib of complementary shape adapted to nest within one of the branches of the star-shaped cut-out 80.

As shown, the transverse end wall 59 of the cutting handle 50 may be formed in one piece with the median part 48 of the cutting handle 15, as a right-angle lip.

As an alternative to this (FIG. 13), it may be formed in two halves by respective right-angle lips on the branches 18 of the cutting handle 15, in which case the star-shaped cut-out 80 has only two branches disposed diametrally relative to each other and each obtained by simply widening locally the corresponding slot 79.

In the embodiment shown in FIGS. 14 and 15 the part 81 of the plunger 62 in which is formed a groove 61 for the end of the return spring 54 for the pivot 16 has, as seen in elevation, a dovetail-shape contour by virtue of which it is snapped over a wear preventing metal plate 8 which is appropriately shaped and which itself has a slot 83 in corresponding relationship with the groove 61.

This wear preventing plate 82, which of itself constitutes the corresponding surface 64 of the plunger 62, forms a rolling strip for the pivot 16 and prevents it digging into the plunger 62 when, as in this case, the latter is made of a synthetic material.

Also, in this embodiment the sides of each of the grooves 73, 74 in the plunger 62 have projecting towards each other in their median part a rib 85 for braking the latch 65 when it is engage in it.

Only the groove 74 can be seen in the figures.

In the embodiment shown in FIGS. 16 through 18 the plunger 62 is of composite rather than unitary construction and comprises a synthetic material core 86 sandwiched between two metal side plates 87 which extend beyond the core 86 to form between them the groove 61.

Bosses 88 stamped into the flanges 87 cooperate nesting fashion with holes 89 provided for them through the core 86.

The grooves 73, 74 are in the core 86 only.

For better retention of the latch 65 in the operative position they each have a narrower section 90.

Figure 5:
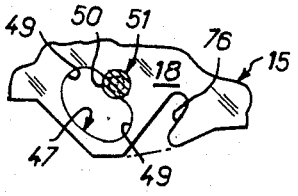
FIG. 5 is a view which also repeats part of that of FIG. 1, showing the other handle.
Figure 6:
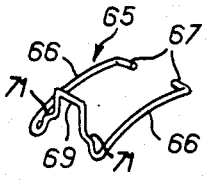
FIG. 6 is a perspective view of a latch of the tightening and cutting tool in accordance with the invention.

In the embodiment schematically shown in dashed line in FIG. 5 the recess 76 in the cutting handle 15 is eliminated as in the hole 77 in the tightening handle 14, for improved mechanical strength.

Demounting is still possible, and is desirable for changing any parts exposed to wear.

This arrangement is also used in the embodiment shown in FIG. 19, in which the previously described latch 65 has also been eliminated.

For locking it in the advanced position in order to demount the tool, the plunger 62 (which is of unitary construction in the embodiment shown, but which could equally well have a sandwich structure of the same kind described with reference to FIGS. 16 through 18) has a hole 92 that has to be lined up with a hole 93 provided for this purpose in the cutting handle 15, in order to insert a screwdriver or other instrument, or any form of rod or pin, into the thus aligned holes.

This operation is naturally carried out with the tool in an appropriate open configuration, after demounting the spring 54, as previously.

In the embodiment shown, instead of being coupled to the pivot 16 the spring 54 is coupled to the plunger 62, which to this end has on its lower surface a recess 95 internally bordered at a localized position by a hook 96.

In this case it is no longer possible to remove the spring 54 completely in order to demount the tool.

It is sufficient to remove the adjuster screw 57.

Released in this way, the spring 54 remains hooked onto the plunger 62, but does not impede the dismantling operation.

The functioning and use of this embodiment are in all other respects of the same nature as previously described.

The present invention is naturally not limited to the embodiments described and shown, but encompasses any variant execution and/or combination of the various component parts.

In particular, the nose of the cutting handle may form an integral part of the handle, being in one piece with its main part.

Also, any grooves in the plunger for a latch if fitted may be replaced by projecting tabs.

There is claimed:

1. Tool for tightening and cutting clamps comprising two handles, a pivot for pivoting said handles to each other, one of said handles being a tightening handle and having at its end grasping means for grasping the clamp to be cut and the other of said handles being a cutting handle and having at its end a movable cutter, elastic means for opposing pivoting movement of said grasping and cutting handles towards each other, actuator means for applying thrust to said cutter, and elastic return means for opposing movement of said cutter, wherein said actuator means defines the pivot for pivoting said handles to each other and a curved slot in said cutting handle by which said cutting handle is fastened to said pivot and in which said pivot is movable parallel to itself and transversely relative to the axis of the pivot.

2. Tool according to claim 1, wherein said curved slot in said cutting handle has a contour which includes a re-entrant part defined by a roller rotatably mounted on said cutting handle.

3. Tool according to claim 1, wherein said slot has end lobes and said pivot for the two handles is acted on by further elastic return means which urge it constantly towards one of the end lobes of said slot.

4. Tool according to claim 3, wherein said further elastic return means associated with said pivot between the two handles comprise a spring.

5. Tool according to claim 4, wherein said spring constituting said elastic return means associated with said pivot between the two handles is coupled to said pivot.

6. Tool according to claim 4, wherein said cutter is mounted for sliding movement and a plunger is disposed between said pivot for the two handles and said cutter and said spring constituting said elastic return means associated with said pivot between the two handles is coupled to said plunger.

7. Tool according to claim 1, wherein said cutter is mounted for sliding movement and a plunger is disposed between said pivot for the two handles and said cutter.

8. Tool according to claim 7, wherein the surface of said plunger on which said pivot bears is oblique.

9. Tool according to claim 7, wherein a latch is associated with said plunger for locking it in position.

10. Tool according to claim 9, wherein for purposes of cooperation with said latch said plunger comprises two spaced grooves or tabs whereby it may be locked by said latch into either of two distinct positions.

11. Tool according to claim 9, wherein said latch associated with said plunger is pivotally mounted on said cutting handle.

12. Tool according to claim 7, wherein said plunger comprises a hole adapted to be aligned with a hole in said cutting handle.

13. Tool according to claim 1, wherein one of said handles has at its end opposite said grasping means a tab adapted to limit its travel relative to the other handle by butting up against the latter.

14. Tool according to claim 1, wherein said cutting handle has a nose cooperable with said cutter and said curved slot has a concave side facing away from said nose.

15. Tool according to claim 1, wherein said elastic return means for opposing pivoting movement of said handles and said elastic means for opposing movement of said cutter are defined by one and the same spring.

16. Tool according to claim 15, wherein said slot has end lobes and said pivot for the two handles is acted on by further elastic return means which urge it constantly towards one of the end lobes of said slot.

17. Tool according to claim 15, wherein said further elastic return means associated with said pivot between the two handles comprise a spring.

* * * * *